US005106428A

United States Patent [19]

Goerss et al.

[11] Patent Number: 5,106,428

[45] Date of Patent: Apr. 21, 1992

[54] METHOD FOR CLEANING CONTAINERS

[75] Inventors: William G. Goerss, Fenton; William J. Farrah, Grosse Pointe Farms, both of Mich.

[73] Assignee: Automated Cleaning Systems, Inc., Westland, Mich.

[21] Appl. No.: 518,177

[22] Filed: May 3, 1990

Related U.S. Application Data

[62] Division of Ser. No. 335,095, Apr. 7, 1989, Pat. No. 4,941,491.

[51] Int. Cl.[5] ..... B03B 3/02; B03B 3/08; B03B 9/093

[52] U.S. Cl. ..... 134/38; 134/111; 134/140; 134/144; 134/168 R; 134/170; 134/102

[58] Field of Search ..... 134/381, 111, 140, 144, 134/168 R, 170, 102, 22.18, 23, 24; 239/227

[56] References Cited

U.S. PATENT DOCUMENTS

| | | | |
|---|---|---|---|
| 1,693,885 | 12/1928 | Butterworth | 134/168 R |
| 2,273,603 | 2/1942 | Verden | 134/23 |
| 2,568,183 | 9/1951 | Bumpus | 134/111 |
| 2,786,000 | 3/1957 | Roach | 134/102 |
| 3,073,325 | 1/1963 | Rebizzo et al. | 134/170 X |
| 3,122,151 | 2/1964 | Chambers | 134/170 X |
| 3,645,452 | 2/1972 | Stoeckel et al. | 134/168 R X |
| 3,645,791 | 2/1972 | Sadwith | 134/144 X |
| 3,724,764 | 4/1973 | Hall | 134/168 R X |
| 3,771,539 | 11/1973 | Santis | 134/111 |
| 4,140,543 | 2/1979 | Soleri et al. | 134/23 |
| 4,163,455 | 8/1979 | Hebert et al. | 134/167 R |
| 4,337,897 | 7/1982 | Hoffken et al. | 239/227 X |
| 4,649,858 | 3/1987 | Sakai et al. | 118/317 X |
| 4,812,255 | 3/1989 | Suwala | 134/38 |

FOREIGN PATENT DOCUMENTS

| | | | |
|---|---|---|---|
| 22359 | 10/1964 | Japan | 118/318 |
| 205274 | 8/1939 | Switzerland | 118/317 |
| 411912 | 10/1974 | U.S.S.R. | 118/317 |

OTHER PUBLICATIONS

GAF Chemicals Corporation Brochure-Copyright 1986.

KBA Inc. Cleaning Systems Brochure-CCI System High Pressure/Low Volume Cleaning Systems for Chemical Industry.

Karcher Instruction Manual-A51020.

*Primary Examiner*—Theodore Morris
*Assistant Examiner*—Zeinab El-Arini
*Attorney, Agent, or Firm*—Harness, Dickey & Pierce

[57] ABSTRACT

Reusable containers such as totes for paint, chemicals and the like are cleaned to exacting standards by apparatus which includes a spray booth and at least an internal spray head. The spray head is moved along a vertical axis to a plurality of different positions within the tote. In addition, the spray head is tiltable about a horizontal axis. In such manner, the spray head can be tilted so that its nozzles are brought very close to the side walls of the container to thereby concentrate the spray of solvent thereon to remove paint residue and the like. An external spray head is also provided for cleaning the external sides of the container while it is being rotated relative to both internal and external spray heads.

3 Claims, 5 Drawing Sheets

METHOD FOR CLEANING CONTAINERS

This is a division of U.S. patent application Ser. No. 335,095, filed Apr. 7, 1989, entitled "Method and Apparatus for cleaning containers", now U.S. Pat. No. 4,941,491.

TECHNICAL FIELD

This invention relates to cleaning equipment and, more particularly, to a method and apparatus for cleaning reusable containers for storing paint, chemicals and the like.

DISCUSSION

Paint and chemical companies often use reusable containers; for example, totes and batch tanks to store products such as paint, chemicals and the like. Various cleaning systems are currently available on the market to clean the used containers before they are filled again. Two known cleaning systems are produced by Alfred Karcher GmbH & Co. of Winnenden, West Germany who is represented in the United States by KBA, Inc. of Belleville, Michigan. These systems generally employ a rotating spray head that sprays cleaning fluid in the interior of the container to remove the paint residue therein. Unfortunately, these prior art systems have not been entirely satisfactory in achieving the objectives of the present invention. These objectives include the provision of high quality, cost effective systems for cleaning these containers that are safe to use while minimizing hazardous wastes.

SUMMARY OF THE INVENTION

In accordance with the teachings of the present invention, apparatus is provided for cleaning containers having an opening in the top thereof. Vertical positioning means are employed for vertically moving an internal spray head along a vertical axis to a plurality of preselected positions within the container. Means are also provided for tilting the spray head about a horizontal axis. As a result, the spray nozzle is brought closely adjacent to the walls of the container and issues cleaning fluid onto the walls at various angles.

In the preferred embodiment of the invention the apparatus includes a booth having an entrance door, an exit door and a roof. The booth is of sufficient dimension to enclose a container which is placed therein. An external, as well as internal, rotating spray jet head is provided. Vertical positioning means are used to vertically move each of the spray heads along respective vertical axes to a plurality of different preselected positions. Tilting means are also employed for tilting both spray jet heads about a horizontal axis. The vertical positioning means and tilting means enable the spray nozzles of both the exterior and interior heads to be brought very close to the walls of the container and directed at the best angles for cleaning. Thus, the high pressure spray issuing from the nozzles is concentrated in a particular area at a given time. Means are also provided for rotating the container about a vertical axis relative to the spray heads. Accordingly, the nozzles are concentrated on essentially all areas of the interior and exterior of the container to achieve maximum cleaning.

In accordance with the broad teachings of the method of this invention, an organic solvent is sprayed onto walls of the container to dissolve paint thereon and to carry the paint away from the container. Paint is filtered from the solvent to reclaim it so that the solvent can be reused again. Preferably, the solvent is N-Methyl-2-Pyrrolidone which is sprayed at a pressure of at least 2,500 psi. The spraying is carried out in a ventilated booth and the paint/solvent residue is drained from the booth into a closed loop reclamation/filtration subsystem.

BRIEF DESCRIPTION OF THE DRAWINGS

Various other features of the present invention will become apparent to those skilled in the art after reading the following specification and by reference to the drawings in which.

DESCRIPTION OF THE PREFERRED EMBODIMENT

Figure 1:
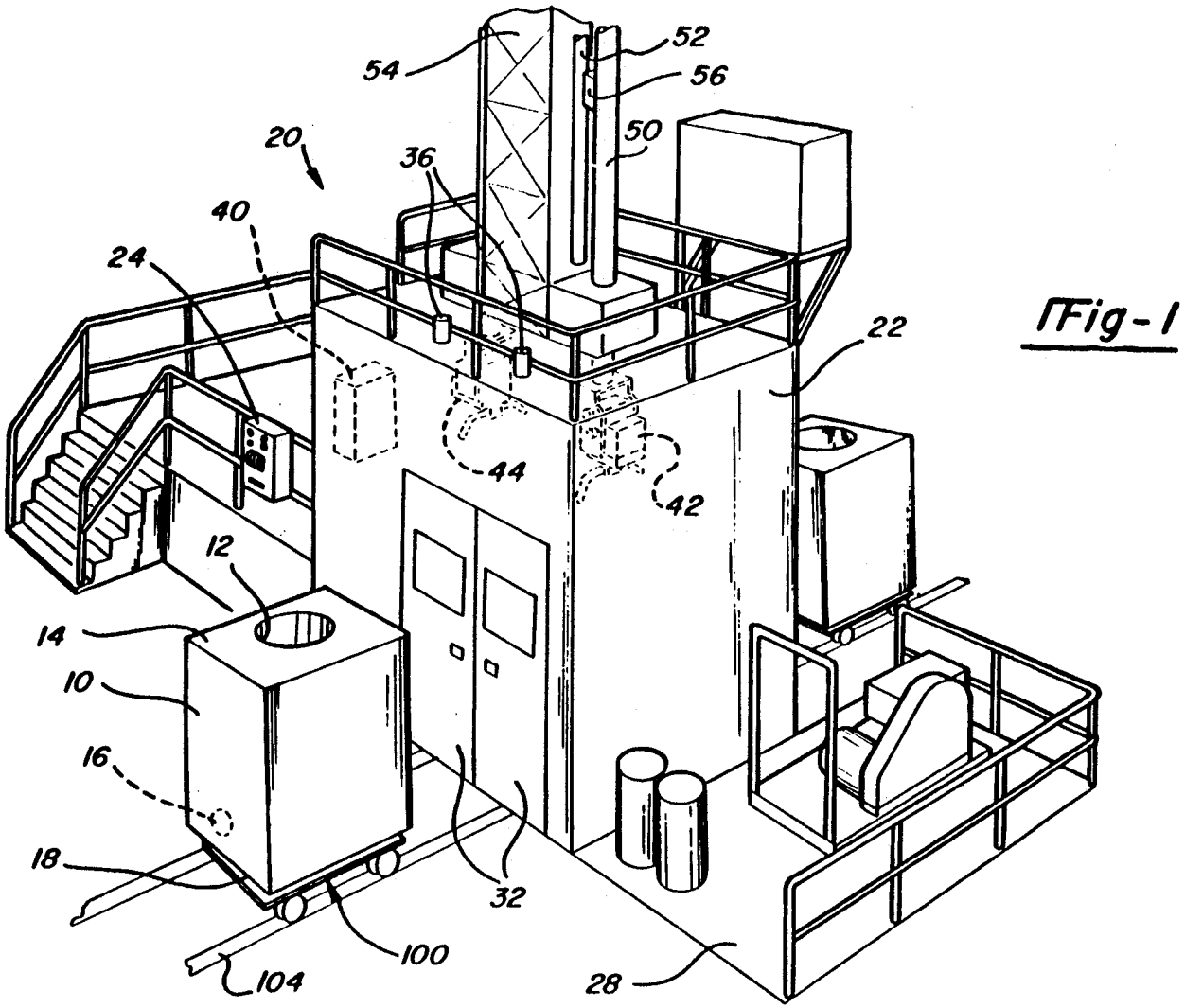
FIG. 1 is a perspective view of apparatus for cleaning containers made in accordance with the teachings of the present invention.

It should be understood from the outset that while this invention will be described in connection with cleaning paint totes, it does have broader applicability since it can be used to clean other types of similarly constructed containers such as open type batch tanks, round or square, and the like.

An exemplary paint tote 10 is illustrated in the drawings. Paint totes come in a variety of sizes but they are generally characterized by a metallic, generally box-shaped hollow construction having an opening 12 in a roof 14 and an outlet hole 16 on one side near the bottom 18 thereof. The outlet hole 16 has provisions for installing a valve for retaining the paint or other various liquids when the tote is full. The totes 10 are used to store paint, chemicals and the like therein. When the contents in the tote 10 are emptied, a residue still r®mains on the walls of the tote. This residue must be cleaned to very exacting standards in order for the tote to be reused.

Turning now especially to FIG. 1, a cleaning system 20 is provided for cleaning totes 10 and other similar containers. In general, system 20 includes a booth 22 where the totes are cleaned, an operator control panel 24 and a reclamation/filtration subsystem 26 shown in more detail in FIG. 2. The reclamation/filtration subsystem 26 can be located conveniently under the floor 28 of a building in which the system 20 is located. An optional rinsing station (not shown) can be provided as desired to rinse the totes 10 after they exit from the booth 22.

Spray booth 22 is of sufficient dimension to enclose a tote 10 which has been placed therein. Booth 22 has a pair of entrance swinging doors 32 and rear exit doors 34. Proximity switches 36 and 38 monitor the position of the doors 32 and 34, respectively. The proximity switches provide signals to the programmed logic control 40 which will shut down the cleaning operation in the event that the doors are not shut or are opened prematurely.

The booth 22 includes two, substantially similar, rotating spray jet heads 42 and 44. Spray head 42 is for cleaning the interior of the tote 10 while spray head 44 is for cleaning the exterior of the tote 10. As will appear, both of the heads 42 and 44 tilt about a horizontal axis and are positioned at various preselected vertical locations. Vertical positioning of the heads is accomplished by substantially identical vertical positioning mechanisms 46 and 48, respectively. Each mechanism includes an elongated aluminum tube 50 which is guided by a sleeve 53 through the roof of the booth 22. A vertically mounted, stationary pneumatic cylinder 52 is secured to a gantry 54. Although only one cylinder is shown, it may be necessary to employ two cylinders ganged together to provide the required lifting force to the tube. Other types of suitable lifting/positioning mechanisms can also be used.

Cylinder 52 incorporates a moving carriage 56 which is attached to the tube 50. The carriage 56 has a pneumatically actuated brake mechanism therein which holds the tube 50 in various vertical positions during the cleaning cycle.

Proximity switches 58(*a–c*) provide signals to the control 40 to stop the carriage 56 at a plurality of vertical positions to clean various size totes or tanks as preselected by the operator by entering the size of the tote in the control panel 24. As will be discussed in more detail later herein, the pneumatic lines and high pressure solvent feed line 60 are routed through the interior of the hollow aluminum tube 50 as can be seen most clearly in FIG. 5.

Figure 5:
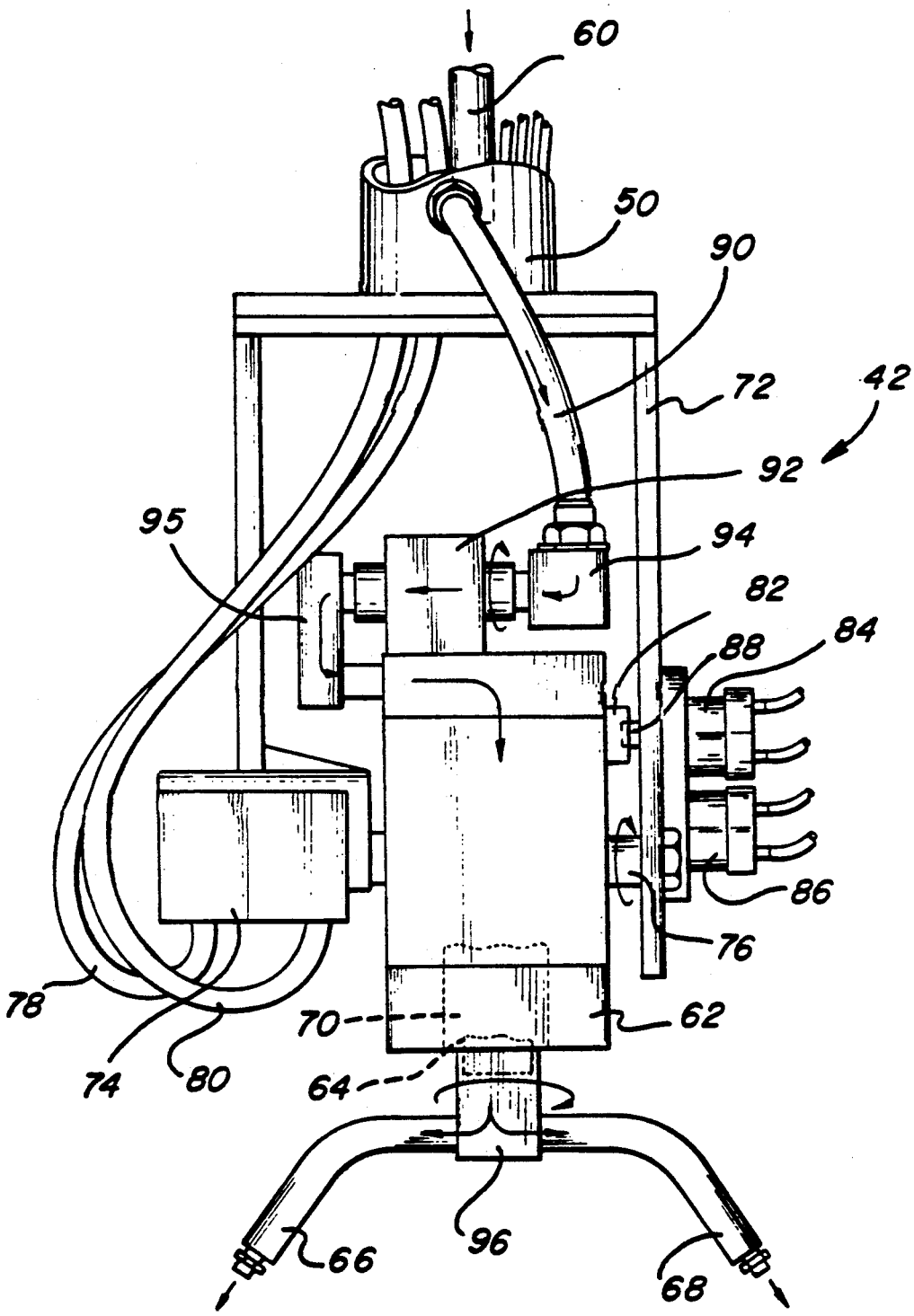
FIG. 5 is a side view of the internal spray jet head in which the head is shown tilted to its vertical down or home position.

The internal spray head 42 is also shown in more detail in FIG. 5. As noted above, the external spray head 44 is substantially similar. Head 42 includes a high pressure rotating seal having a cylindrical body 62 with a rotating discharge shaft 64. The discharge shaft 64 is in fluid communication with a pair of generally U-shaped nozzle arms 66 and 68 which are configured to provide a concentrated rotating spray pattern to all inside surfaces of the tote 10 through nozzle orifices designed for high impact forces of the cleaning fluid on the interior surfaces for maximum cleaning efficiency. Shaft 64 is driven by a pneumatic motor 70. The rotating seal body 62 and pneumatic motor 70 are carried by a yoke 72 mounted to the lowermost side of tube 50. Provision is made for tilting the spray head 42 to various positions as shown most clearly in FIGS. 3(*a–c*). A pneumatic actuator 74 (FIG. 5) provides the necessary up or down tilting forces to rotate body 62 about a horizontal axis provided by the shaft of both 76. The motor 74 is connected to body 62 so that it tilts it about shaft 76 in either a clockwise or counterclockwise direction depending upon the direction of the force applied to the air pressure lines 78, 80.

Figure 3A:
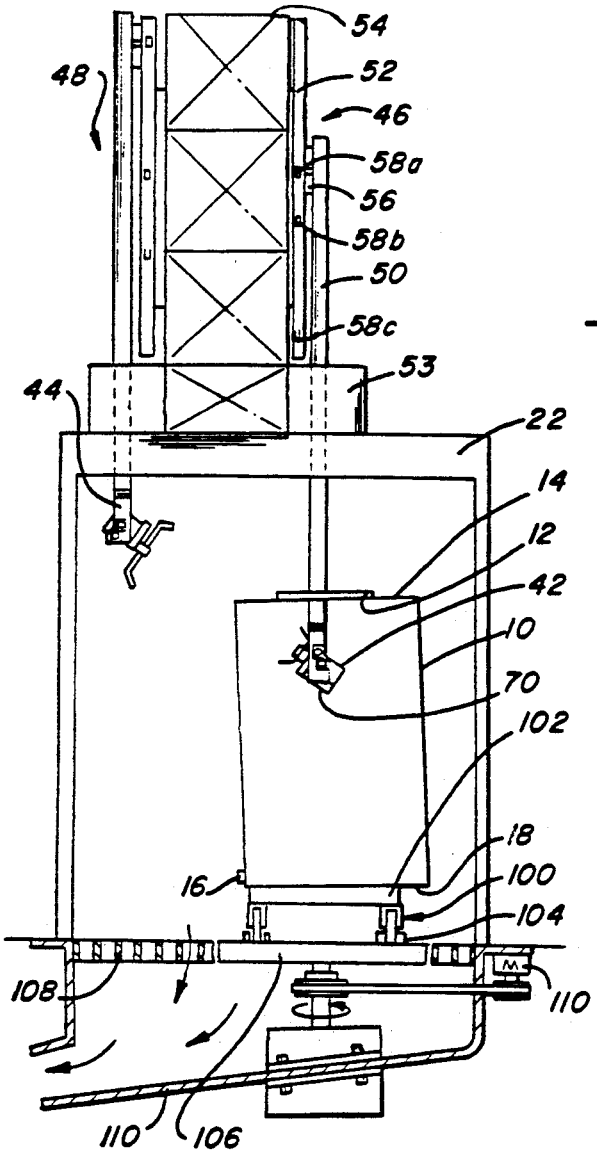
FIGS. 3(*a–c*) are side views showing a paint tote during successive steps in the method of being cleaned by the apparatus of the present invention.
Figure 3B:
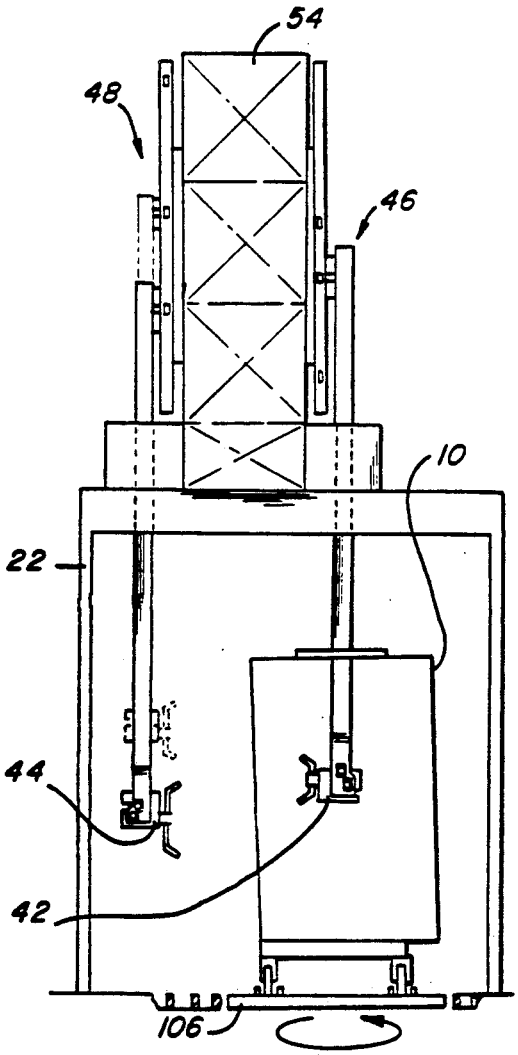
Figure 3C:
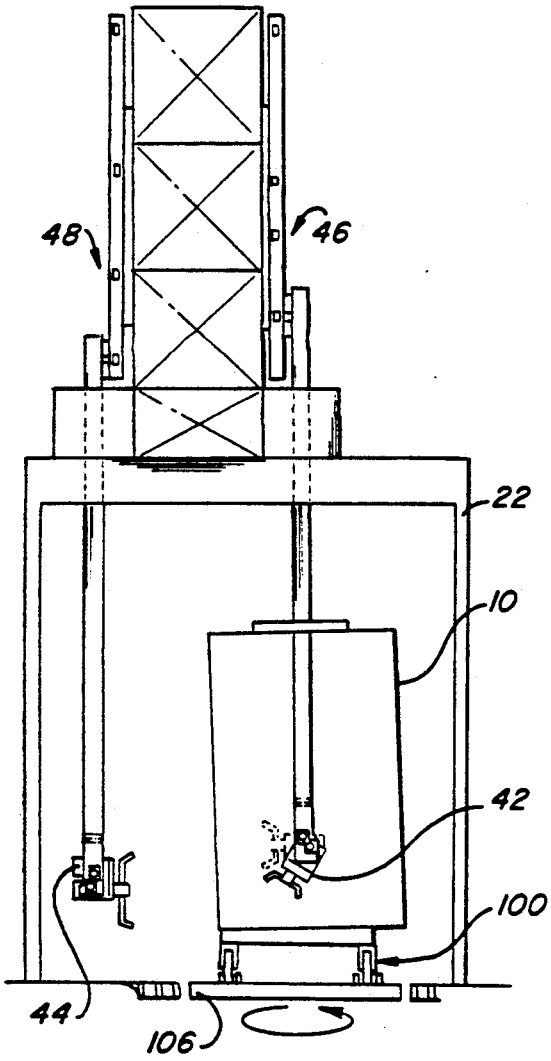
Figure 4:
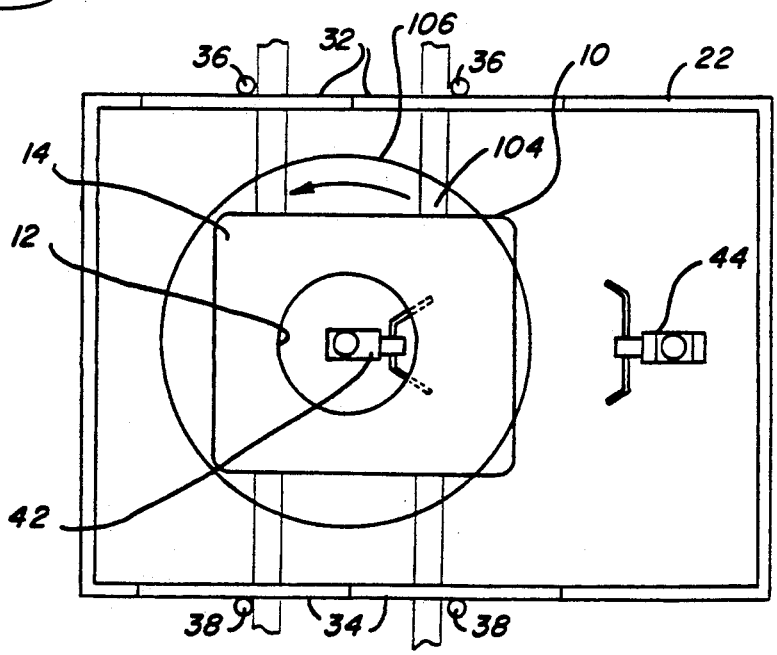
FIG. 4 is a top view looking down on a rotating tote as it is being cleaned.

In this embodiment the head 42 is tiltable to four different positions: a vertical down or home position (FIG. 1), a 45 degree down position (FIG. 3*c*), a horizontal position (FIG. 3*b*), and a 45 degree up position (FIG. 3*a*). To reach these programmable positions, the motor 74 is actuated to tilt the body 62 in the appropriate direction until a tab 82 thereon abuts a stop. Two hard stops are fixed to the sides of the yoke 72 to provide the stops for the 45 degree up and vertical down position. Two retractable stops are provided for the 45 degree down and horizontal position. These retractable stops are moveable into the path of tab 82 by cylinders 84 and 86. In FIG. 5, one such retractable stop 88 is shown. As noted above, the forced air is supplied to the various cylinders and motors through the hoses which are routed through the tube 50.

The high pressure cleaning fluid is similarly routed through tube 50 by pipe 60 which, in turn, is connected through flexible hose 90 and L-shaped fitting 94 to a swivel 92. The swivel 92 and flexible hose 90 accommodate for the horizontal tilting of the spray head. The fluid passes through swivel 92 and then through a swivel manifold 95 back into the body 62 of the rotating seal. Presently, however, it has been found that the swivel is not necessary and the flexible hose 90 can be directly connected to the rear of body 62 through a 90 degree fitting. Fluid is then delivered through the discharge shaft 64. The outer end of the discharge shaft 64 is connected to a hub 96 which in turn diverts the water through the nozzle arms 66 and 68.

By way of a nonlimiting example, the high pressure swivel body 62 is a modified form of a rotary seal commercially available from Automated Jetting Systems of Westland, Mich.; motor 70 is made by Desontter as Part No. 5126; while motor 74 is Part No. 18250002 available from Tol-O-Matic of Minneapolis, Minn.

A four-wheeled dolly 100 is provided for carrying the tote as can be seen most clearly in FIGS. 1 and 3. Provision is made for tilting the tote 10 at an angle towards the outlet 16 so that residue can be easily drained from the interior of the tote and will exit through the outlet 16. This function can be accomplished in a variety of manners such as by making the receiving platform 102 of the dolly 100 with sloped upper surfaces. The wheels of the dolly are received by guide tracks 104 mounted on the floor 28 as well as on a turntable 106 located in the bottom of the booth 22 at the level of floor 28. The remaining bottom portions of the booth 22 are defined by grates 108 which are level with the surface of the turntable 106.

Provision is made for rotating the tote 10 about a vertical axis. In the preferred embodiment, turntable 106 is rotated by a motor 110 via a chain and pneumatic motor at various desired rates. A sloped drain pan 110 is located beneath the grate 108 and serves to direct the paint residue and cleaning solvent towards a transfer pump in the reclamation/filtration subsystem 26.

In operation, the operator enters the desired tote size into the control panel 24, as well as selects whether the interior, exterior or both should be cleaned. The programmable logic control 46 has been programmed to control the vertical positioning and horizontal tilting of the spray heads depending upon the size of the tote to be cleaned. The tote 10 on the dolly 100 is wheeled into the booth 22. Conveniently, the tracks 104 may have suitable detents (not shown) into which the wheels may fall somewhat in order to properly position the tote 10 on the turntable 106. The doors 34, 36 are closed and the operator can initiate the cleaning sequence by pressing a suitable "start" button or switch on the control panel 24. This causes the vertical positioning mechanism 46 to move spray head 42 downwardly through the opening 12 in the tote 10. At its home position (fully retracted) the spray head 42 is tilted vertically downwardly as shown in FIG. 1. Spray head 42 maintains this vertical down orientation as it passes through the opening 12 during the beginning of the cleaning cycle so that the nozzles 66, 68 can pass freely through the opening 12 in the tote without interference.

Once the head 42 passes through opening 12, the air motor 74 is activated to cause the head to rotate to its 45 degree up position as shown in FIG. 3(*a*). The motor 110 is also energized to cause the platform 106 to rotate. Thus, the tote 10 is rotated in relation to the head 42. As will be described, the valves in the reclamation/filter subsystem 26 are set so that all available high pressure solvent is delivered to the spray head 42. Motor 70 is also energized to cause the nozzles 66 and 68 to rotate about the spray axis. For purposes of this invention, the spray axis is the general direction in which cleaning fluid is directed against the walls of the container. More particularly, in this embodiment the spray axis would be defined by the axis of rotation of the hub 96 carrying the nozzles 66 and 68.

In the position shown in FIG. 3(*a*) the cleaning fluid issuing from the spray head 42 cleans the inner upper walls and upper corners of the tote. As shown in FIG. 3(*b*), the vertical positioning mechanism 46 is then actuated to lower the spray head 42 to its next position. In addition, motor 74 is actuated to tilt the spray head so that its spray axis is generally in the horizontal direction. After a appropriate period of time (for example, one revolution of the tote or one minute) the vertical positioning mechanism 46 is again actuated to move the tube 50 and lower the head 42 to the next position as shown, for example, in FIG. 3(*c*). After the spray has cleaned the lower side walls of the tote, the air motor 74 can then again be actuated to rotate the head 42 to its 45 degree down position for cleaning the bottom of the tote. Finally the internal spray head 42 is rotated to its vertical down position and raised upwardly through the opening 12 in the tote and returned to its home position.

The cleaning sequence for the exterior of the tote follows the interior cleaning process and is substantially the same as for the interior. The valves in the reclamation/filtration subsystem 26 are set so that the high pressure fluid is instead delivered to the external spray head 44 which is vertically positioned and tilted as shown in the drawings to clean the exterior of the tote while the tote is continued to be rotated by turntable 106. After the exterior of the tote is cleaned, the solvent pressure to the head is reduced to stop the supply to the booth. The rear doors 34 of the booth can then be opened and the dolly 100 pushed out of the booth towards a rinsing station, if desired.

The tiltability of the spray heads, the vertical positioning capability and the rotation of the tote 10 all cooperate to provide an efficient and reliable method of cleaning the tote. The nozzles of the spray heads, especially the internal spray head 42, are brought into close proximity with essentially all areas of the walls of the tote. The solvent issuing from the spray head nozzles is delivered at a pressure of at least 500 psi and, more preferably, between 2,500–10,000 psi.

The solvent is preferably an organic solvent in the form of a heterocyclic compound classified as aprotic solvent. N-Methyl-2-Pyrrolidone has been found to provide superior results in reacting and solubilizing the paint on the containers so that the solvent/paint residue can be easily carried away from the booth. The N-Methyl-2-Pyrrolidone solvent has an Empirical formula of $C_5H_9NO$ and is commercially available under the trademarks NMP and M-PYROL from GAF Corporation. This solvent is characterized by a high flash point (204 degrees F.), low toxicity and low vapor pressure. Because of the characteristics of this particular solvent, the system of the present invention is not susceptible to explosions which might otherwise occur if other solvents are pressurized to the high degree provided by the present invention.

Figure 2:
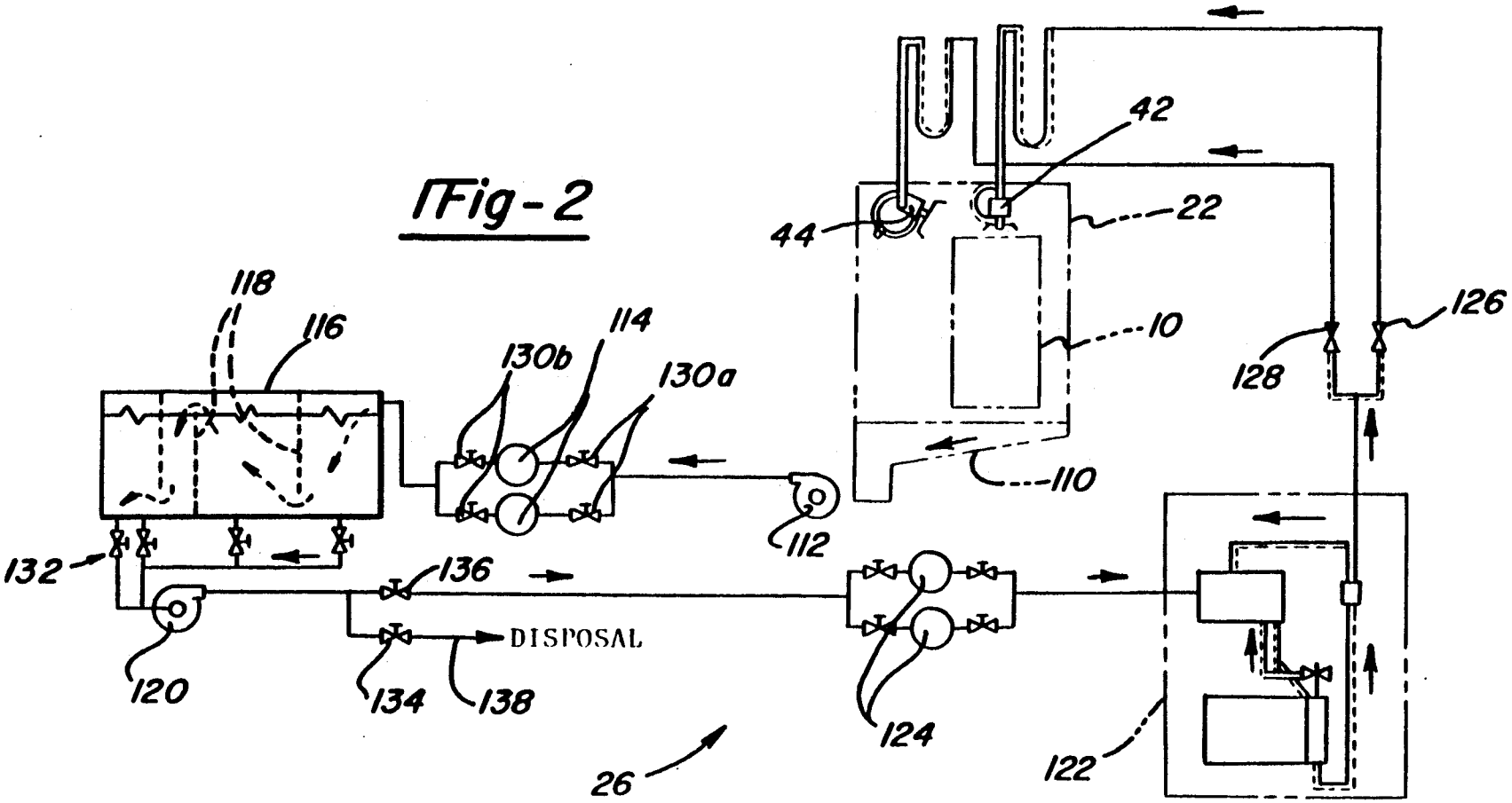
FIG. 2 is a schematic flow diagram of the reclamation/filtration subsystem for the cleaning solvent used in the apparatus of FIG. 1.

During the tote cleaning process, paint residue and solvent are collected, filtered and repressurized by a closed loop reclamation/filtration subsystem 26 which is shown in more detail in FIG. 2. Transfer pump 112 pumps the paint residue and cleaning solvent through a set of filters 114 to a holding tank 116. Tank 116 includes a set of weirs 118. The residue is introduced into one end of the tank 116 and caused to flow over and under the weirs 118 to cause any paint residue to migrate or settle to the bottom of the tank 116. Valves are provided to drain off the accumulated paint residue, as will be discussed later herein. The cleaned and filtered solvent is withdrawn from the other extreme end of the tank 116 by a supply pump 120 which delivers the solvent to a high pressure pump 122 through a set of filters 124. A vacuum distillation unit (not shown) can also be used in the closed loop subsystem 26 to aid further in the reclamation of the solvent. The high pressure pump 122 increases the pressure of the reclaimed solvent and supplies it to either the internal spray head 42 or external spray head 44 through valves 126 and 128, respectively. When the cleaning operation is completed, the high pressure pump 122 remains running and the valves 126 and 128 are closed while the valves 130 are opened to allow the solvent to be returned directly to a rinse header (not shown) for rinsing any residue on the drain pan 110 towards the pump 112.

In view of the foregoing, it can be appreciated that the present invention provides a variety of advantages over known cleaning systems. Totes and similar containers can be cleaned quickly and efficiently while minimizing safety hazards to the operator and outside environment. Fumes from the solvent and paint are contained within the booth and appropriately exhausted. The paint residue and solvent are all maintained within the closed loop subsystem 26 which provides for easy disposal of the waste. Waste can be drained from tank 116 by opening valves 132, 134 and closing valve 136. In such manner, pump 120 can be used to pump the residue through disposal output line 138. Further advantages of the present invention include the design and construction of the various system components which are chosen for their reliability and extended wear. After having the benefit of studying the drawings and the above specification, those persons skilled in the art will realize that various other advantages of the present invention are obtainable and that modifications thereof can be made without departing from the spirit and scope of this invention.

What is claimed is:

1. A method of cleaning paint from a container, said method comprising:

a) spraying an organic solvent at high pressure onto walls of a container to dissolve paint thereon and carry the paint away from the container;

b) effecting movement of said spraying organic solvent or said container during spraying such that said spraying cleans said container;

c) filtering the paint form the solvent to reclaim the solvent; and d) reusing the reclaimed solvent wherein reclaimed solvent from a high pressure pump is alternately supplied to an interior and exterior spray head, each of the spray heads being moveable along a vertical axis and tiltable about a horizontal axis to clean interior and exterior walls of the container, respectively, while the container is rotated in a booth.

2. The method of claim 1 wherein the solvent is N-Methyl-2-Pyrrolidone which is sprayed at a pressure of at least 2,500 psi.

3. The method of claim 2 wherein step b) is performed in a closed, ventilated booth and wherein step c) is performed in a closed loop system wherein paint/solvent residue is drained from the booth, pumped through at least one filtration device, and returned to the spray heads within the booth by the high pressure pump.

* * * * *